US005517593A

United States Patent [19]

Nenniger et al.

[11] Patent Number: 5,517,593

[45] Date of Patent: May 14, 1996

[54] CONTROL SYSTEM FOR WELL STIMULATION APPARATUS WITH RESPONSE TIME TEMPERATURE RISE USED IN DETERMINING HEATER CONTROL TEMPERATURE SETPOINT

[75] Inventors: John Nenniger, 4512 Charleswood Drive N.W.; Regina D. Nenniger; Stephen J. Conquergood, all of Calgary, Canada

[73] Assignee: John Nenniger, Alberta, Canada

[21] Appl. No.: 384,895

[22] Filed: Feb. 7, 1995

Related U.S. Application Data

[63] Continuation-in-part of Ser. No. 185,612, Jan. 24, 1994, abandoned, which is a continuation-in-part of Ser. No. 767,704, Sep. 30, 1991, Pat. No. 5,282,263, which is a continuation-in-part of Ser. No. 590,755, Oct. 1, 1990, Pat. No. 5,120,935.

[51] Int. Cl.[6] ..... E21B 7/15; H05B 3/02

[52] U.S. Cl. ..... 392/301; 392/305; 166/60; 166/66; 166/302; 166/250.01; 219/494; 219/506; 364/557

[58] Field of Search ..... 392/301–306; 166/60, 66, 250, 302; 219/494, 506; 364/557, 477

[56] References Cited

U.S. PATENT DOCUMENTS

| | | | |
|---|---|---|---|
| 4,127,169 | 11/1978 | Tubin et al. | 392/301 |
| 4,423,625 | 1/1984 | Bostic, III et al. | 166/250 |
| 4,597,290 | 7/1986 | Bourdet et al. | 166/250 |
| 4,790,375 | 12/1988 | Bridges et al. | 392/301 |
| 4,862,962 | 9/1989 | Prouvost et al. | 166/250 |
| 4,919,201 | 4/1990 | Bridges et al. | 166/60 |
| 5,120,935 | 6/1992 | Nenniger | 392/305 |
| 5,282,263 | 1/1994 | Nenniger | 392/301 |

*Primary Examiner*—John A. Jeffery

[57] ABSTRACT

A control system for well stimulation equipment including a source of electrical power, a source of injection fluid, a fluid injection system, and a downhole electrical heater, electrically connected to the source of electrical power includes one or more of temperature and pressure sensors both above and below grade for the purpose of monitoring process conditions. The sensor output is gathered in a computational unit and then manipulated for process control. The control system includes a response time which is defined as the time between a no flow condition at the heater and a shutting off of power, which response time is used to establish a temperature set point for the well stimulation equipment. A method of stimulating hydrocarbon recovery is also disclosed.

18 Claims, 7 Drawing Sheets

CONTROL SYSTEM FOR WELL STIMULATION APPARATUS WITH RESPONSE TIME TEMPERATURE RISE USED IN DETERMINING HEATER CONTROL TEMPERATURE SETPOINT

This is a continuation in part of Ser. No. 08/185612, filed Jan. 24, 1994, now abandoned, which is a continuation in part of Ser. No. 07/767704, filed Sep. 30, 1991, now U.S. Pat. No. 5,282,263, which is a continuation in part of Ser. No. 07/590755 filed Oct. 1, 1990, now U.S. Pat. No. 5,120,935.

FIELD OF THE INVENTION

This invention relates generally to the field of control systems and in particular to control systems of the type that sense various remote operating conditions, and which provide set responses for process control in reaction to such sensed operating conditions.

BACKGROUND OF THE INVENTION

In the past, it has been recognized that heaters may be useful in assisting hydrocarbon production from underground formations. Some of these heaters have been installed at the bottom of the well and the heater provides a fixed heat output. However, if the fluid flow is interrupted for any reason then heat generated by the heater is not adequately removed, so the temperature of the heater rises until a catastrophic failure of the heater (i.e., burnout) occurs. For example, U.S. Pat. No. 3,410,347 to Triplett, teaches using a burner as a means of producing heat at a remote underground location to stimulate hydrocarbon production from the well. However, the heater temperature produced by the Triplet burner is a function of the fuel flow rate, the air flowrate, fuel to air ratio, the burner pressure, the fuel atomization efficiency at the elevated downhole pressures, heat transfer surface area, heat transfer coefficients and fluid throughput through the heater. In spite of these factors which would greatly affect the safe and reliable operation of the burner, no control system is taught or even proposed by Triplett.

U.S. Pat. Nos. 2,484,063 and 2,500,305 to Ackley include the use of a current controller for the purpose of controlling downhole temperatures. Ackley teaches a device used to apply heat to air or steam which are used to deliver heat to the reservoir. Although Ackley suggests monitoring the downhole temperature, Ackley does not teach use of an adequate control system for controlling the temperature of the heater.

My own patent U.S. Pat. No. 5,120,935 discloses a heater for the purpose of heating solvents which are injected into the formation for the specific purpose of removing plugging wax deposits. The treatment time and cost of operating such a heater is directly related to the throughput and outlet temperature. Higher fluid throughput allows shorter treatment times so that the capital cost of the equipment can be spread over more treatments (wells). Higher throughput can also allow higher bottom hole injection pressures to be achieved with beneficial consequences on the effectiveness of the stimulation. For example, if an oil well has multiple producing zones, then any production zones that have been damaged or plugged by waxy solids may be at a higher fluid pressure than the adjacent depleted zones, so higher injection pressures may be necessary to achieve fluid inflow into the damaged zones.

The injection of fluid into a well is typically characterized by varying injection pressures and varying flowrates. These variations in flowrate and pressure arise due to a number of factors. The maximum allowable injection pressure is usually limited by physical constraints, such as the burst strength of the tubing or casing and the fracture pressure in the reservoir. If the injection pressure approaches one of these constraints the flowrate must be reduced. During the process of fluid injection into the well the near wellbore area becomes "charged" with fluid and the injection pressure required to achieve a constant flowrate increases. Offsetting this trend, is the removal of formation damage which facilitates fluid movement away from the near well bore area and tends to reduce the fluid injection pressure. The injection fluid is typically pumped from the surface using a pump which is driven by a truck engine or the like. Such truck engines will likely have other simultaneous loads, such as hydraulic subsystems (i.e., to operate a blow out preventer or B.O.P) which affect the engine speed and the amount of power available to drive the above-grade pump. Variations in hydraulic load can cause flow rate variations.

As the flowrate changes, the heater must respond in a timely way to maintain an outlet temperature within a desired range (deadband) around an optimal temperature or setpoint. The worst case scenario may be when fluid injection is suddenly interrupted due to a failure of the above-grade pump or a leak in the tubing. In this case, the temperature in the heater can rise very rapidly or "ballistically" because the injection fluid does not carry the heat away from the heater. Thus, to achieve a controlled temperature at the outlet of the heater, it is necessary to have a fast response control system to adjust the power output to the heater. Furthermore, in the worst case scenario described above, the control system must recognize a problem and respond by shutting off the power to the heater quickly enough to avoid dangerous overheating.

Smaller and more compact heaters (such as shown in my U.S. Pat. No. 5,120,935) allow higher throughputs without excessive pressure drop and also facilitate equipment handling and transport. For example, throughput of the heater can be doubled (at the same pressure drop) by reducing heater length by a factor of four. However, this doubling of throughput will increase the required power output in the heater by a factor of two and therefore the power output per unit volume is increased by a factor of eight and the ballistic rate of temperature increase will be eight times faster. Therefore to maintain adequate control, the control system response times have to be eight times faster. Thus, a shorter and more high-powered heater requires an ever faster control system response.

Mechanical thermostat type control devices as taught in the prior art cannot respond quickly enough to keep the temperature within a useful control range for high power heaters. For example, to control the heater outlet temperature within 10° C. in the heater described in my own prior patent U.S. Pat. No. 5,120,935, the overall control system (including temperature sensors and power controls) should have a response time of less than 1.5 seconds since the ballistic heating rate of the heater in a "no-flow" condition is about 7° C. per second. Such a response time can be achieved with mechanical thermostatic type controls. However, to double the power output, the response time of the overall control system should be less than 200 milliseconds (=1.5/8 seconds) to achieve control within the same deadband.

BRIEF SUMMARY OF THE INVENTION

Thus, while it is desirable to maximize the throughput (and power output) of a heater of the type described in my own prior U.S. Pat. No. 5,120,935, safe and controlled operation of the heater is required at the same time.

What is desired therefore is a process control system which combines sensors, data acquisition, (i.e., process monitoring) with flow rate, temperature and power controls (i.e., control) for the purpose of ensuring that downhole temperatures and fluid throughputs are on the one hand properly balanced, but on the other hand are running at optimal process rates. Preferably, such a control system would be fast acting, stable and would automatically prevent either the production of too much heat energy (excess temperatures) or too low a fluid flow rate for the optimal operation of the heater.

Additionally, it is desirable to provide a process control system which permits tight control of the treatment parameters, to allow the treatment to be done as quickly and at as low a cost as possible, to make the stimulations suitable for even marginally economic producing wells.

Therefore, there is provided according to one aspect of the present invention, a method of stimulating hydrocarbon recovery from a well, comprising the steps of:

a) providing a well stimulation apparatus including a downhole heater in the well, a source of electrical power, conductors connecting said downhole heater to said source of electrical power, and a fluid injection system including a source of fluid and a pump for pumping the fluid, b) connecting a control system to the well stimulation equipment, the control system including one or more of temperature, pressure and flow sensors to sense the flow of fluid past said heater and into a formation surrounding said well, a central computational unit and means for communicating readings from said sensors to said central computational unit, said central computational unit including means for receiving and manipulating said sensor readings and generating a control signal for said source of electrical power to vary the power to achieve a set point temperature at said heater;

c) establishing a maximum temperature which if exceeded is likely to cause damage to the well or the stimulation equipment;

d) determining a response time which is a length of time between the beginning of a no flow condition at the heater and the receipt, by the source of electrical power, of a control signal from the control system substantially shutting down the source of electrical power;

e) calculating the temperature rise which occurs at the heater during said response time, f) subtracting the temperature rise calculated from step e) from the maximum temperature established in step c) to obtain a desired operating temperature; and g) setting the set point temperature of said control system at or below said desired operating temperature and f) injecting fluid past said heater into said formation, Wherein said control system maintains said fluid temperature exiting said heater at about said set point.

According to a second aspect of the present invention there is provided a control system for well stimulation equipment, the well stimulation equipment including a downhole heater in the well, a source of electrical power, conductors connecting said downhole heater to said source of electrical power, and a fluid injection system including a source of fluid and a pump for pumping the fluid, the control system comprising:

one or more of temperature, pressure and flow sensors to sense the flow of fluid past said heater and into a formation surrounding said well, a central computational unit and means for communicating readings from said sensors to said central computational unit and from said central computational unit to said source of electrical power, said central computational unit including means for receiving and manipulating said sensor readings and generating a control signal for said source of electrical power to vary the power to achieve a set point temperature at said heater, said control system having a response time defined as the time between a no flow condition occurring and a control signal from said control system substantially shutting off said source of electrical power;

wherein said set point temperature is set at about a maximum permissable temperature less the temperature rise over time for a no flow condition in said heater times said response time.

According to a further aspect of the present invention there is also provided, a well treating system for stimulating hydrocarbon recovery from an underground formation, the formation being connected to a well extending from the formation to the surface and having a well head located at or near the surface, the well treating system comprising:

a downhole electrical resistance heater which may be inserted into the well and located adjacent to the hydrocarbon bearing underground formation, the downhole heater having a rate of increase of temperature in a no flow condition at full power defined as a ballistic heat rate;

a source of electrical power located at or near the well head;

a microprocessor controlled power regulator;

electrical conductors connected between the source of electrical power and the downhole heater for conducting electrical power to the downhole heater;

a source of fluid located at or near the well head;

at least one pump located at or near the well head for pumping a fluid from said fluid source past said downhole heater and into the formation;

at least one first sensor, associated with the downhole heater, for providing at least one first output signal corresponding to an outlet temperature of said fluid flowing past said heater;

at least one second sensor, associated with said well, for providing a second output signal corresponding to the flow rate of fluid flowing past the downhole heater and into the formation; and a control system comprising one or more of temperature, pressure and flow sensors to sense the flow of fluid past said heater and into a formation surrounding said well, a central computational unit and means for communicating readings from said sensors to said central computational unit and from said central computational unit to said source of electrical power, said control system receiving and manipulating said sensor readings and generating a control signal for said source of electrical power to vary the power to generally maintain a set point temperature at said heater, said control system having a response time defined as the time between a no flow condition occurring at said heater and a control signal from said control system substantially shutting off said source of electrical power;

wherein said set point temperature is set at or less than a maximum permissable temperature for said well less the product of the ballistic heating rate for said heater times said response time.

BRIEF DESCRIPTION OF THE DRAWINGS

Reference will now be made, by way of example only, to preferred embodiments of the invention as illustrated in the accompanying drawings and in which.

DETAILED DESCRIPTION OF THE PREFERRED EMBODIMENTS

Figure 1:
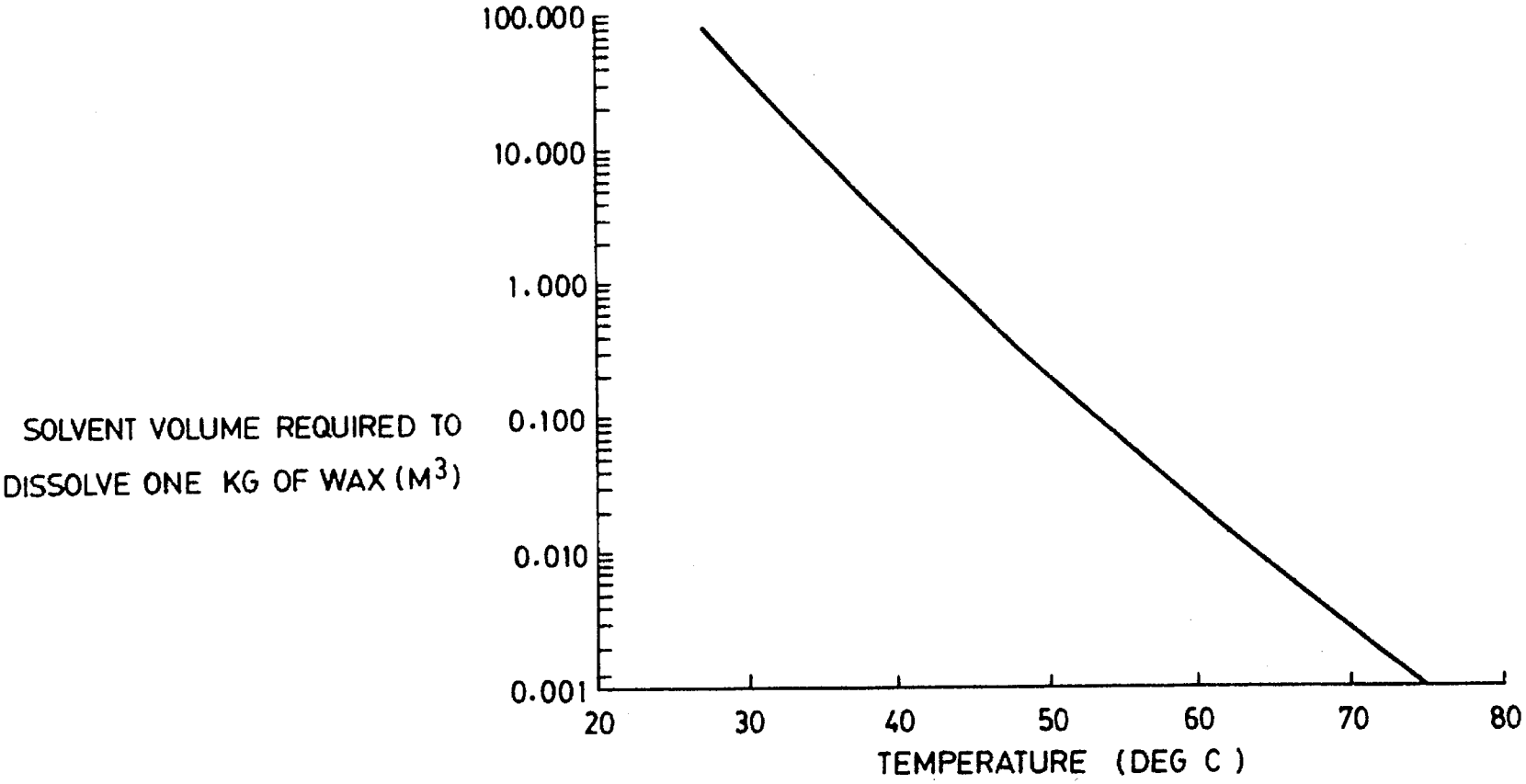
FIG. 1 is a graph depicting the relationship between solvent volume requirement to dissolve a downhole wax deposit (in $m^3$ solvent/kg of wax) against treatment temperature in degrees Celsius.

Up until the present, the composition and solubility of wax has not been well understood. Typically, wax has been treated as a single compound and its solubility has been assumed to be a weak function of temperature. One of the techniques used by industry to remove wax deposits from wells is to employ solvents; a solvent is pumped or "squeezed" into the formation to dissolve the wax. Although this technique has been frequently used, the composition of the wax deposit has generally not been known, and so the solubility of the reservoir wax in the solvent is not known either. FIG. 1 shows a solubility curve of the volume of a typical solvent required to dissolve 1 kilogram of a typical wax deposit as a function of temperature. For a reservoir temperature of 40° C., more than 2 $m^3$ of solvent are required to dissolve just 1 kilogram of wax. In general, excessive volumes of solvent are required to remove wax damage at reservoir temperature.

However, FIG. 1 also shows that if the solvent can be heated to 70° C., then only two liters of solvent are required per kg of wax deposit. Although different solvents are slightly more or less effective, the effect of temperature (i.e., the slope of the curve in FIG. 1) is similar for many different solvents. Thus, one surprising result is that the application temperature of the solvent is extremely important in increasing the effectiveness and usefulness of any such solvent treatment. However, what remains is how to effectively heat the solvent in a controlled manner to achieve the desired result. In this context it will be appreciated that one desired result is the removal of wax by heating the solvent to measurably increase production or injection rates through the treated area. In this context, to heat the solvent means that the solvent has had its temperature raised above the naturally occurring temperature of the reservoir.

Figure 2:
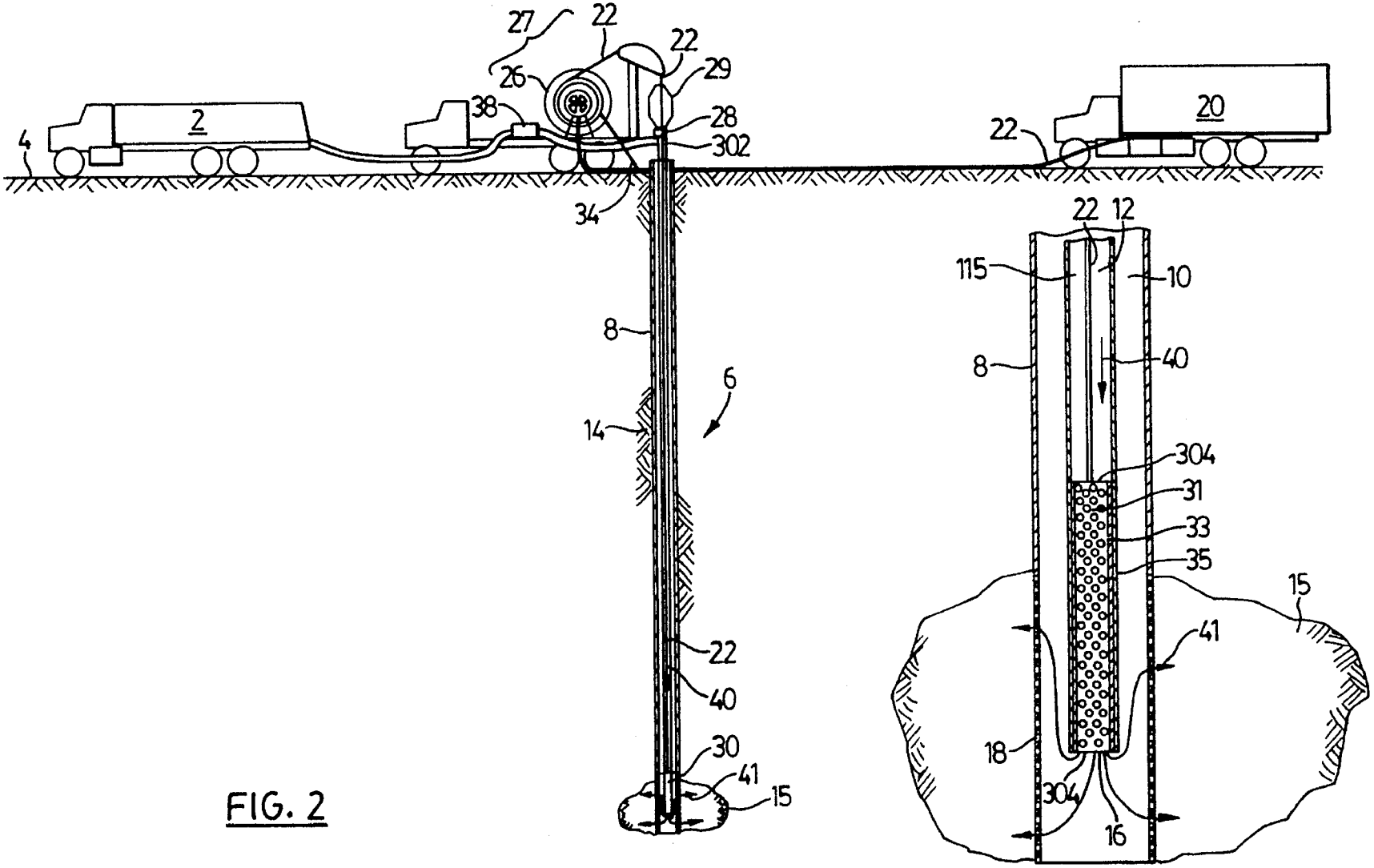
FIG. 2 is a preferred embodiment of the apparatus to be controlled.

An oil well is shown schematically and oversized in FIG. 2, generally as 6, with an outer casing 8 forming an annulus 10 around a tubing string 12. The casing 8 penetrates through the overburden rock 14 to a recovery zone 15. The production tubing 12 hangs inside of the casing 8 and generally extends from the wellhead to a location near the recovery zone 15. At the bottom of the tubing string 12 is an opening 16 which allows fluid communication between the inside of the production tubing 12 and the annulus 10. Numerous perforations 18 are provided in the outer casing 8 at the recovery zone 15. The perforations 18 allow fluid to flow between the annulus 10 and the recovery zone of the formation 15.

An apparatus suitable for being controlled by a control system according to the present invention is generally illustrated as FIG. 2. The apparatus comprises a power supply 20, a tanker truck supplying fluid 2, a pump 38 for pumping the fluid 40, and a downhole heater 30.

The power supply 20 has a power outlet cord comprising electrical conductors 22. The power supply 20 preferably includes a portable diesel electric type generator, although in situations where the well 6 has an adequate supply of electrical power, the generator may be replaced by a conventional electrical power grid hook-up, along with appropriate transformers, rectifiers and controllers. Dependent on the application, it may be advantageous to convert the alternating current (AC) power to direct current (DC) as more power can be carried by a given conductor 22 in DC operation and inductive coupling between the conductor 22 and the tubing 12 is also avoided. Furthermore DC power creates less electromagnetic noise and thereby reduces the noise levels on signals from any downhole sensors. Thus, DC power is most preferred.

The next component is a conductor assembly, which includes a spooling apparatus 27 which raises and lowers the conductors 22 within the tubing 12. The spooling apparatus is preferably a coiled-tubing rig. It has been found preferable to have the electrical conductors 22 placed within the coiled tubing to protect them from mechanical damage and provide additional tensile strength. The wires for the heater are also protected from the possibly harsh environment of the well in this manner.

The conductors 22 (inside the coiled tubing) pass around the reel 26, through injector 29 and through a lubricator 28. In the preferred case where the cables are run inside coiled tubing the lubricator is also called a stripper. The lubricator 28 facilitates the passage of the insulated conductor 22 into and out of the wellhead of the tubing 12. The lubricator 28 is also adapted to provide a pressure seal around the cables as required. The spooling apparatus 27, and power supply 20 will be familiar to those skilled in the art. Consequently, they are not described in any further detail herein.

The electrical conductors 22 are preferably in the form of insulated electrical cables, and include both instrument wires for any downhole sensors as well as power conductors. At the bottom end of conductors 22 is shown the resistive heater 30.

Figure 3:
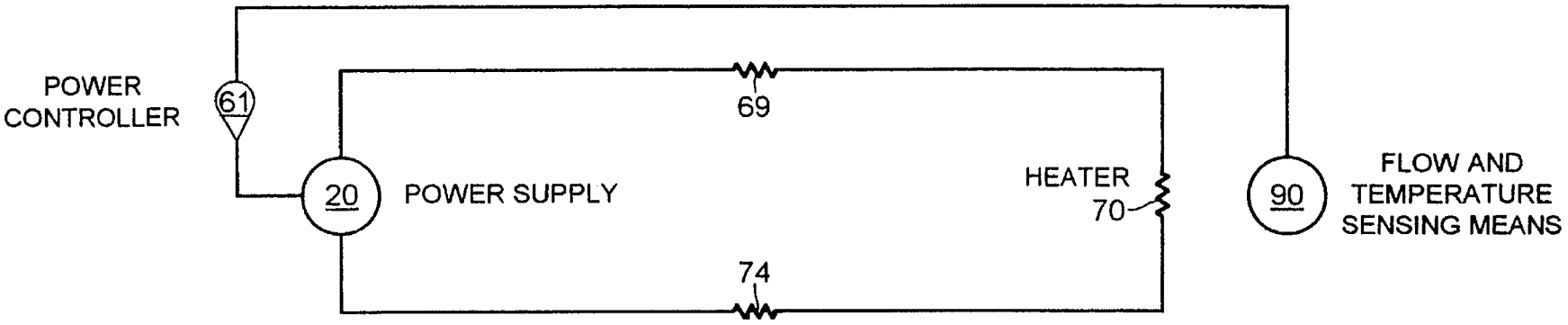
FIG. 3 is a circuit diagram of the preferred power circuit.

FIG. 3 shows a preferred electrical circuit for the apparatus, schematically, including the resistance 69 of conductor 22 on the downward limb of the circuit and resistance 70 caused by the heater 30, which is the most preferred form, is a packed bed heater. The resistance 74 of the return limb of the conductor 22 is also shown. A control means 61, explained in more detail below, is also shown connected between the power supply 20 and a temperature and/or flow sensing means, such as a thermocouple or flowmeter or the like, shown as 90.

For a given power or heat transfer rate, higher solvent flowrates will result in lower heater outlet temperatures. Alternatively, a high heater outlet temperature can be obtained at a lower power by reducing the solvent flowrate. FIG. 1 shows that the required solvent volume decreases by three orders of magnitude for a 30° C. temperature rise. Thus, even a small temperature rise can provide a substantial benefit in terms of reducing solvent volume requirement.

However, as the hot solvent is displaced into the pores in the reservoir formation or rock matrix, the hot solvent will cool down and the rock and immobile interstitial fluids will be heated. A large fraction of the cost of the solvent type of stimulation is typically due to the cost of the solvent injected downhole. Thus, it is desirable to heat the solvent to the maximum feasible temperature which avoids solvent degradation and deleterious effects in the reservoir, such as mineral transformations. In this manner a maximum amount of heat or thermal energy is carried by a minimum volume of solvent.

It may now be appreciated how the most preferred heater 30, a packed bed heater, may be placed into the well 6. The electrical cable 22 with the heater 30 is spooled off the spooling apparatus 26 through the lubricator 28 to the appropriate depth within the tubing 12. The solvent truck 2, then begins to pump solvent into the well 6 at a desired rate by means of a pump 38.

The solvent then makes its way down the inside of the production tubing as indicated by arrow 40 where it encounters the resistive heater 30. In some circumstances it may be advantageous to use the coiled tubing as the conduit for the solvent. The power supply 20 is started and electrical power is then transmitted through electrical cable 22 and through the tubing 12 to the heater 30. As the solvent is pumped down the tubing 12, with the valve on the annulus 10 closed, it passes through the heater 30, out the bottom orifice 16 of the tubing 12, through the perforations 18, in the casing 8 and into the recovery zone of the formation 15. In some cases it may be necessary to seal the annulus 10 to prevent the solvent from circulating upwards. In addition, it may be desirable to use a packer, gelled hydrocarbons or non condensible gas to reduce heat losses due to convection in the annulus. In the case where there is no production tubing in the well it may desirable to use a packer to seal the outside of the heater to the casing and thereby force the solvent to flow through the heater and then out into the reservoir.

When sufficient solvent has been displaced into the formation, the power to the heater can be switched off. The conductors 22 and the heater 30, may then be removed from the well and the portable equipment removed from the well head site. The well may be put back onto production. Alternatively, the hot solvent may be left to soak for a period of time before the well is put back into production.

The flow rate of the solvent into the formation is determined by the pump capacity and pressure drop across the heater, as well as the desired solvent temperature rise for the available power supply and the general desirability of avoiding injection pressures so high that the tubing or casing is burst or the formation is fractured. The depth of heat penetration into the formation will depend upon the total volume of solvent injected and the solvent temperature. The optimum distance for the heated solvent 41 to penetrate into the reservoir 15 will depend on the amount and depth of wax damage and will vary from well to well.

Figure 4:
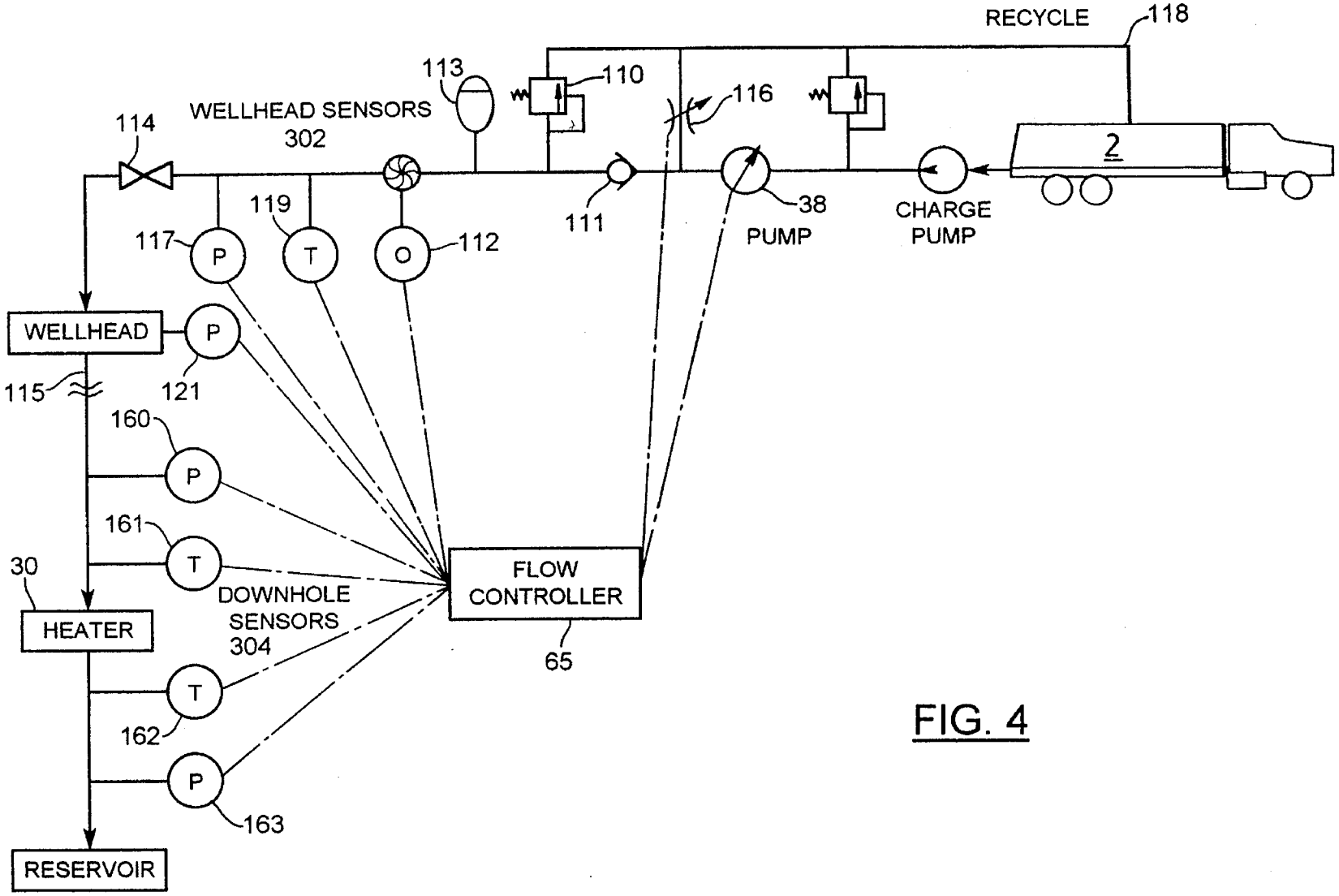
FIG. 4 is a flow diagram of the preferred fluid delivery circuit.

To control the apparatus, comprised of the power supply 20, the heater 30, and the pump 38, means simultaneously controlling two separate subsystems which act in parallel, namely a power system to deliver energy to the heater as shown in FIG. 3, and a fluid system to deliver fluid to the heater as shown in FIG. 4. As will be appreciated by the following description, at the heater 30, the electrical power is transformed into heat energy which is transferred to the fluid to be heated. The heated fluid 41 is then preferably displaced into the underground formation 15. For ease of understanding, each of the power system and the heater, on the one hand, and the fluid injection system, on the other hand, are separately described in more detail below.

It will be appreciated that the delivery of the fluid and the power to the heater, and the displacement of the heated fluid 41 into the reservoir 15, is a dynamic system, having interdependent elements. For example, at higher fluid flow rates, more power to the heater is required to maintain the fluid outlet temperature at any given desired temperature set point. Conversely, if the fluid flowrate through the heater is reduced, then the heater power must also be reduced to avoid overheating with excessively high temperatures. The injection pressure at a given injection rate tends to change over time; it tends to decrease as the plugging waxy solids are removed from the near well bore area and then increase as the near wellbore area is "charged" with fluid.

POWER SYSTEM

Turning first to the power system it is generally illustrated in FIG. 3, and it begins with a generator 204 and power regulator 208, which are sometimes jointly referred to herein as the portable power supply 20. The power regulator 208 preferably includes silicon controlled rectifiers. While access to a power grid may be occasionally available, this apparatus is intended to be used in situ at remote well locations where access to power is limited. Therefore, it is preferred to make the present invention self contained to maximize its applicability.

The preferred form of generator 204 is a diesel powered 750 kW output three phase alternating current generator. The generator 204 itself is preferably oversized with a rating of 1000 kVA, to accommodate the power harmonics and feedback noise produced as the silicon controlled rectifiers in the power regulator 208 act on the electrical output from the generator 204. As will be appreciated by those skilled in the art, other forms and sizes of generator could also be used, but the foregoing is preferred.

In the preferred configuration the power regulator 208 includes a transformer to increase output voltage and has silicon controlled rectifiers of the 12 pulse type for the purpose of converting AC power to DC power. The rectifier is controlled to allow the desired amount of power to be delivered to the heater 30 via the conductors 22. The power regulator 208 also preferably has sensing functions to measure the power. FIG. 3 shows the electrical resistances in the power circuit as the conductors (69, 74) and the heater itself 70.

The next element in the power system is the power control means 61, which combines sensing functions with control functions. The sensing functions will be described below under the data acquisition heading. The principle sensing functions are temperature and flow. The power control functions are twofold, either supply a new setpoint for the power supply, or shutdown the power supply in the event of an fault condition. It will be noted in FIG. 5 that there is also an interlock circuit shown as 220, which allows the central processors to bypass the control means 61 to directly shut off the power. This provides a very rapid power shut down which bypasses the IEEE 488 bus (shown as 206 in FIG. 5) to eliminate communication protocol delay in an emergency shutdown situation.

FLUID INJECTION

The fluid injection equipment will now be described In more detail with reference to FIG. 4. The fluid supply 2 could be of any conventional type, including tanker truck, rig tank or the like. While the preferred operation of the apparatus is as an injection system for injecting de-waxing solvents, which includes crude oil and the like, the apparatus is also appropriate for gas or water or other types of fluid injection and for other treatment techniques and thus the term fluid, in this application, is intended to include both liquids and gases.

The preferred injection pump 38 will vary according to the fluid being pumped, but for a liquid solvent 40, such as crude oil, a triplex type pump is appropriate. To ensure consistent injection and to avoid cavitation at the suction side of the injection pump, an additional charge pump may be desirable.

From the injection pump, the fluid is then displaced through a manifold containing a pressure control/relief valve 110, a check valve 111, and an accumulator (pulsation dampener) 113. Wellhead sensors 302 include a flowmeter 112 to measure fluid flowrate, fluid temperature 119, and annulus pressure sensor 121 and a tubing pressure sensor 117. The fluid 40 then flows past a shut off valve 114, into the wellhead and down the annulus 115 between the tubing and the coiled tubing. The fluid then flows past the coiled tubing, which has been by now uncoiled and inserted into the well, until it reaches the bottom of the coiled tubing, where the heater 30 is located. Downhole sensors 304 include heater inlet pressure 160 and inlet temperature 161 as well as heater outlet temperature 162 and outlet pressure 163. The fluid 40 is forced into contact with the heater elements 31 (FIG. 2), thereby being heated, and is then injected out into the resevoir or formation as shown at 41 (in FIG. 2).

The injection pressure/flow rate is controlled by controlling the pump 38 speed, or it may be controlled through a computer controlled bleed valve 116 (FIG. 4). Such a bleed valve 116 would be located after the pump 38, but near the pump exit orifice and would simply have a return line 118 to the supply tank 2. Use of this type of fluid/pressure control would allow the pump 38 to operate at constant speeds, extending the useful life of the equipment.

In general, it is desirable to inject at the maximum fluid flowrate which can be achieved. High injection pressures can force heated fluid into damaged (and consequently over pressured) zones in need of stimulation. The maximum allowable injection rate is usually limited by the maximum allowable pressure. The engineering data for that particular reservoir/well is used to determine the maximum allowable pressure before the treatment begins. The maximum pressure may be limited by a number of factors, such as the tubing burst pressure, the rated wellhead pressure, the casing burst pressure or the formation fracture pressure. Thus, the maximum allowable injection rate will change during the treatment due to factors which affect the injection pressure, such as removal of near wellbore damage, fluid viscosity reduction as the zone around the well is heated, and "charging" of the near wellbore area with the high pressure injection fluid.

RESISTANCE HEATER

In general, as the fluid throughput for the heater 30 is increased, the power output of the heater must also increase to achieve the same outlet temperature. However, the pressure drop across the heater increases as the square of the velocity. The rapid increase in pressure drop as throughput increases, can result in excessive pressure drop at high throughput rates. This high pressure drop is a consequence of the effectiveness of momentum transfer between the fluid and the heater and is directly related to the effectiveness of heat transfer between the heater elements 31 and the fluid.

Thus, to achieve increased fluid throughput, it is necessary to limit the pressure drop and thereby avoid mechanical or structural damage to the heater 30. If thermal degradation of the fluid is not a problem, then a shorter heater with a high power output can meet these design objectives. For example, to double the fluid throughput, the fluid velocity must double, and so the bed length must be reduced by a factor of four to keep the pressure drop across the bed within acceptable limits. Thus, to double the fluid throughput, the power output per unit volume of the heater must increase by a factor of eight (doubling the power and decreasing the volume by a factor of four). Consequently, if the fluid flow is interrupted for any reason (e.g., a pump failure, leak etc.), then the response times of the power control for the heater must be eight times faster to achieve the same degree of temperature control (control deadband).

Thus, according to the present invention there is provided a very fast microprocessor based type control system to permit improvements in the heater design to be reflected in heater performance. This enables a stimulation to be performed at a maximum injection rate or throughput for maximum effectiveness. Although the requirement for a fast, accurate and stable heater control system is described below in the context of the packed bed heater as described in my earlier patent, it will be appreciated by those skilled in the art that the microprocessor based control system described herein could apply to other heater designs and applications as well.

The preferred heater design 30 is a flow through electrical resistance heater of the type disclosed in my prior patent, which is incorporated herein by reference. The preferred configuration is one which has a high power output, together with a high flow through capacity for maximizing heat transfer. The preferred configuration is of a plurality of discrete heater elements 31 (see inset in FIG. 2) which have point contacts with a number of adjacent elements. The preferred configuration of the elements is generally rounded although other shapes may also be appropriate.

The heater body preferably comprises an outer casing 33 and an insulated lining 35 which contains a packed bed of heating elements. A plurality of channels may be used to provide for an appropriate length and thus resistance. Alternatively, depending upon the power output needed and the resistance of the elements, only one channel may be necessary. Preferred materials for the heater elements 31 include, stainless steel, other metals, alloys, ceramic composites, semiconductors, and even minerals and graphite. As will be appreciated by those skilled in the art, the final choice for the resistive elements is a function of the power requirements for the heater and the bed dimensions so that the overall resistance is properly matched with the power supply.

The preferred heater is characterized by a high heat transfer coefficient and a large surface area per unit volume. This results in a heater of compact volume, which is capable of being inserted into a typical oil well, and which has good surface power rates. Good in this sense means rates which minimize the residence time of the fluid in the heater and which reduce the temperature gradient between the heater elements and the fluid being heated.

While reference is made in this application to a preferred heater design comprising a flow through packed bed of heating elements 31, useful results may also be obtained by using other forms of resistance heater elements. The preferred heater configuration is only one type of heater that may be usefully used. In general, electrical heat is preferred because of the high power output, ease of use, fast response, compactness, consistency and predictability of output and convenience. However different configurations of elements are also possible, and would depend upon the application.

CONTROL SYSTEM

Reference will now be made to the control system, and for ease of understanding, this description is divided into the following sections: data acquisition elements, control system architecture, control system algorithm, and controller hardware.

DATA ACQUISITION ELEMENTS

Figure 5:
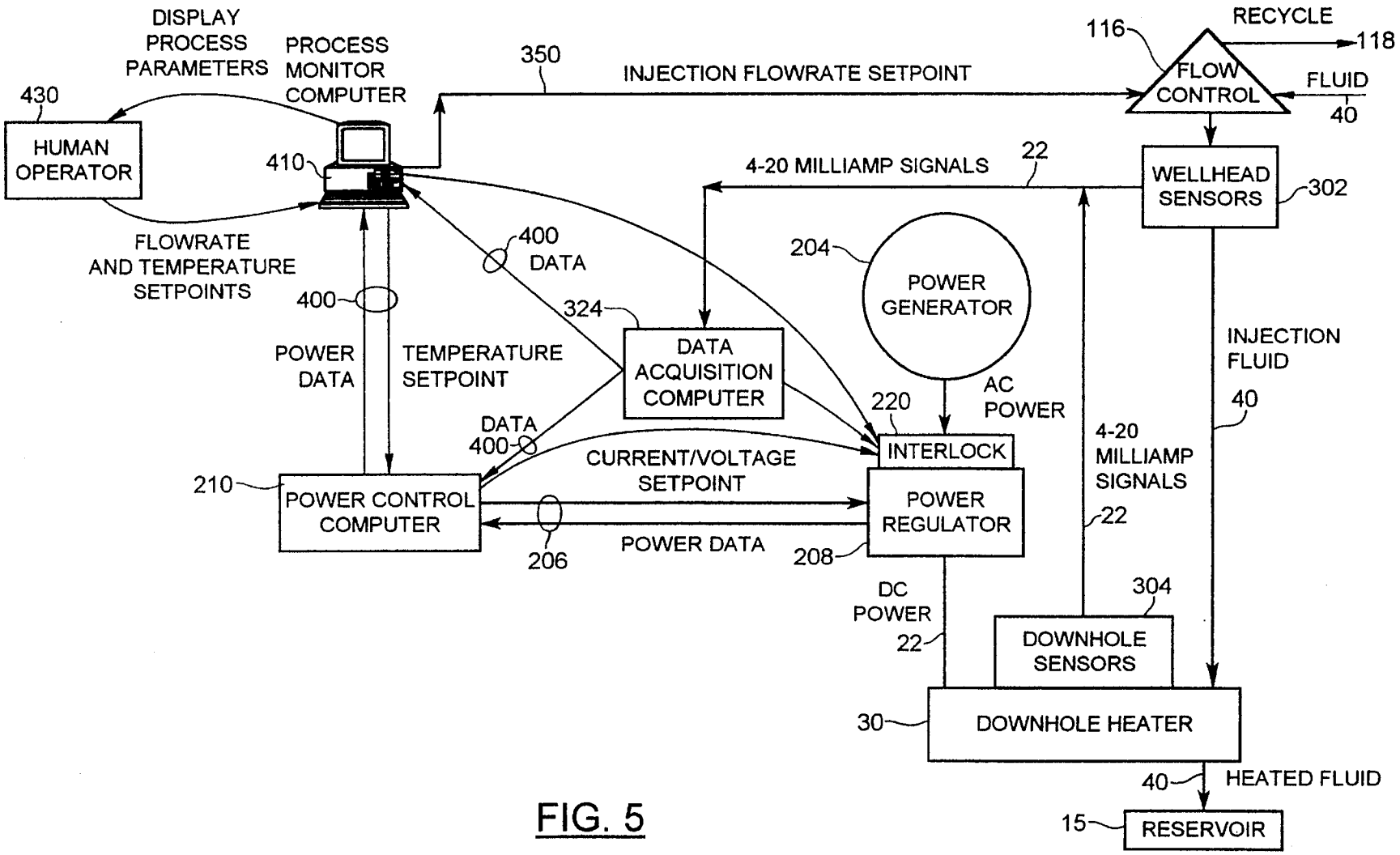
FIG. 5 illustrates a preferred architecture for a control system according to the present invention.

The data acquisition elements may be divided into three main groups, namely, power sensors (included in the power regulator 208 in FIG. 5) which acquire information relating to the power circuit as set out in FIG. 3, and physical sensors shown as 302 (wellhead) and 304 (downhole) in FIG. 5 which acquire information relating to pressures, fluid flow rate and temperatures relating to the fluid injection as outlined above.

The downhole sensors 304 include pressure transducers at the heater inlet and the heater outlet together with resistance temperature detectors or RTD's at the inlet and outlet. The RTD's detect temperature via changes in electrical resistance.

In association with each of the physical sensors, there is preferably provided a 4 to 20 milliamp transmitter to boost the signal strength (i.e., increase signal to noise ratios). The preferred type of transmitter is a two-wire transmitter. The 4–20 milliamp transmitters only let a calibrated amount of current go through the loop as a function of the sensor temperature or pressure or flow rate. This type of transmitter is particularly suited to remote sensing applications because the current signal is not attenuated in long wires. Moreover, if a wire in a loop was damaged (i.e., broken), then the current would decrease to 0 milliamps and a fault condition could be immediately recognized. Thus, fault detection is built into this type of transmitter. Finally, the low amperage and voltages at which these units operate means that they are intrinsically safe with there being no possibility of sparking or the like in an inappropriate circumstance.

In some circumstances, it may be possible to use the sensors without 4–20 milliamp transmitters. The advantages of a simpler, less costly arrangement have to be offset against the disadvantages of lower signal to noise ratio and possible signal attenuation. For the downhole sensors, the feasibility of not using 4–20 milliamp transmitters depends on the ripple current (i.e., ac noise) produced by the power supply and the design and the inductive and capacitive coupling between the power conductors and the sensor conductors in conductors 22.

Returning to the surface sensors 302, two pressure transducers are preferred, one to measure the injection pressure 117 (inside the production tubing 115) and one to measure the pressure 121 in the annulus 10 between the tubing and the casing of the well. Measuring the pressure in the annulus 10, between the tubing and the casing can provide some redundancy to enable the control system to calculate downhole pressure independently of the downhole pressure sensor, provided there is a fluid column in the casing-tubing annulus 10 all the way to the wellhead. Even though downhole pressure is to be measured directly, it is useful to have an independent check on the measure and this check is provided by knowing the fluid density of the injection fluid, the depth at which the bottom hole pressure is being measured, and the pressure head at the top. With these parameters, bottom hole pressure can be calculated and compared to the measured bottom hole pressure to provide an additional fault detection capability.

Wellhead sensors 302 also include a flowmeter 112. The preferred flowmeter has a 4 to 20 milliamp output and would be mounted after the check valve 111 and relatively close to the wellhead. Preferably it would be mounted past the pressure relief valve 110 and the bleed valve 116 of the pump 38 in order that fluid could be bled off without altering the measured flow rate as explained below.

In the wellhead sensors 302, it is preferred to use a RTD sensor 119, adjacent to the flowmeter, for the purpose of measuring the injection fluid temperature. By knowing both the pressure, temperature and the volume of the flow, mass transfer rates can be calculated. The output from the physical sensors is collected, for example in a microprocessor 324, which acts as a data acquisition microprocessor.

In order to obtain the signals from downhole it is sufficient to use AWG No. 18 wire. The resistance of this wire at 6,000 feet in length provides approximately 38 ohms. It will be appreciated that the preferred manner to deliver the signals along this wire and minimize the risk of noise or other interference in the signals is to minimize the ripple in the power supply and to have the AWG #18 wires twisted and double shielded. The sensor signal wires are preferably bundled into the power conductor cable 22. The downhole sensors 304 include heater inlet pressure 160 and temperature 161 as well as heater outlet temperature 162 and pressure 163.

In general, the analog signals from the wellhead and downhole sensors would be digitized in the data acquisition computer 324 and passed as digital signals within a Local Area Network (LAN) 400.

The power supply 20 of FIG. 3 is shown in more detail in FIG. 5. The power supply includes a diesel electric generator 204, and a power regulator 208. Turning first to the power sensors, the power regulator 208 includes two analog sensors to measure voltage and current of each phase of the three AC phases coming from the generator 204. An additional sensor detects ground current faults between the regulator and the generator.

The power sensors are built into the power regulator 208. The averaged three phase alternating current and voltage are measured and then digitized and this information is sent in digital form through an IEEE 488 interface 206, or some other industry standard communication bus, to a computer 210. This computer 210 is subsequently referred to as the power control computer. The power control computer 210, receives the power sensor data from the power unit and in turn passes this data to a process monitor computer 410 in a manner described below.

In addition to the AC sensors there are also DC output voltage and DC output current sensors. Additionally, it is preferred to have a status sensor as well as a fault sensor. These different sensors provide data output signals which can be used for the purpose of power unit control. This data is also passed via the IEEE 488 bus to the power control computer 210. The manner of control is also outlined below in association with the description of the power unit controller algorithm.

CONTROL SYSTEM ALGORITHM

According to the present invention there is provided a control system which is made up of the microprocessors 210, 324 and 410 in a LAN 400, for the purpose of collecting the data from the sensors, and a computational means or program software for manipulating the data, recording the data, and providing output signals for the purpose of controlling different aspects of the stimulation apparatus. The preferred control system algorithm is set out below. The architecture is largely determined by time delays required to execute the various functions. For example, the computer interface 420 (via keyboard, mouse and monitor) to the human operator 430 can introduce long delay times (1–5 seconds) as new temperature or flowrate setpoints are entered. So this interface, is performed at a high level (i.e., the so called "master" level) while at the "slave" level (208–210), the power control is handled by fast and efficient algorithms which can proceed without interruption during the data entry.

Figure 6:
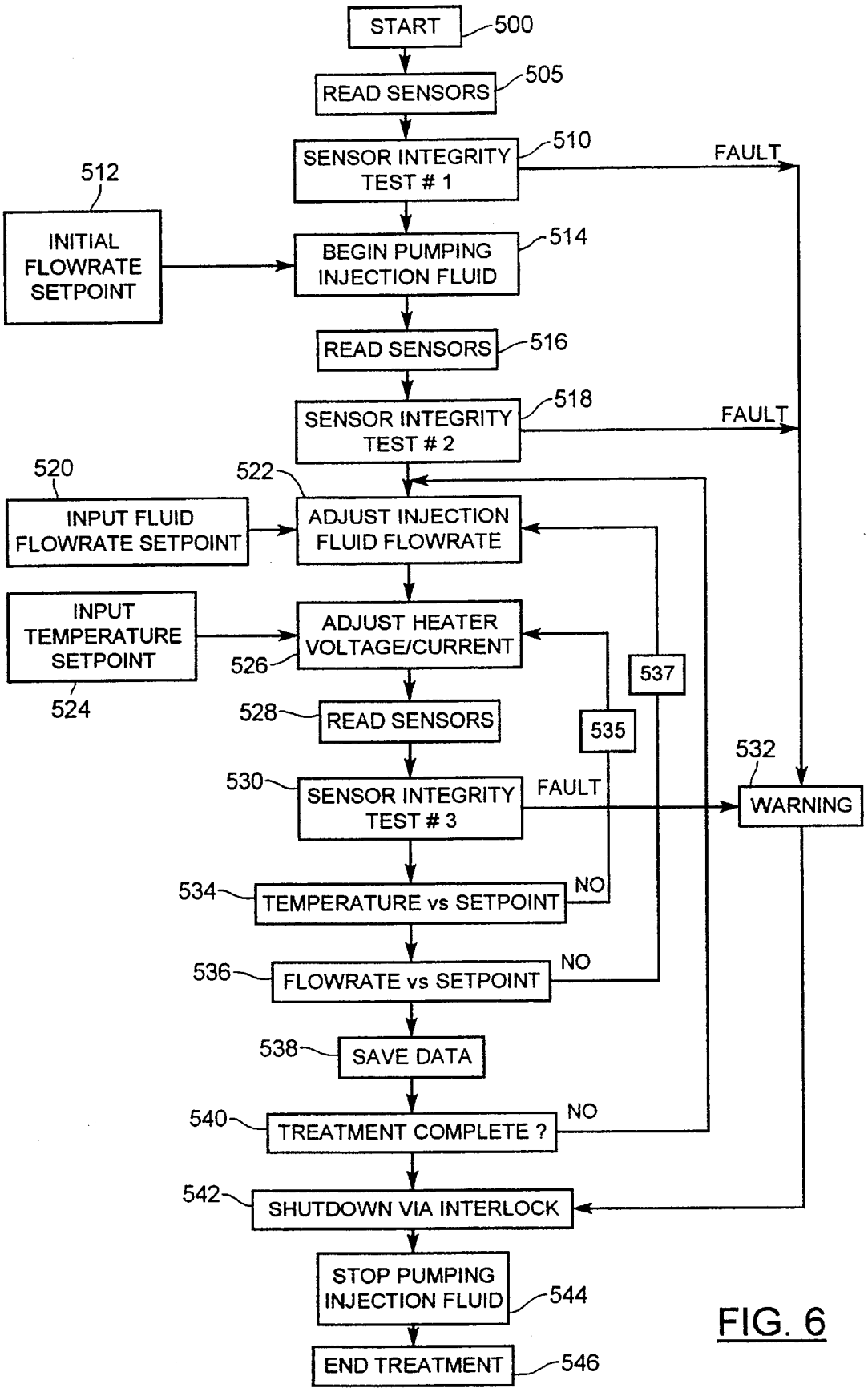
FIG. 6 illustrates a preferred algorithm for a computational unit of the controller according to the present invention.

The first step 500 to start the system is achieved by powering up the microprocessors as shown in FIG. 6. It is preferred to conduct several initial system diagnostic checks 510 of the sensors 505 to detect faults before energizing the heater. These diagnostics are sometimes referred to as integrity tests and can provide simple checks to ensure that the sensors are functioning appropriately and identify malfunctions and faults before a serious control failure arises. The first diagnostic 510 could include checking to see that the readings from the sensors are non zero (i.e., no broken wires). Additional tests 510 could include verification that the heater inlet and outlet pressure differ by the appropriate hydrostatic head difference (before the pump is started).

The next step requires that the flow of injection fluid is initiated and is shown as 512 and 514. This step will cause fluid from the fluid supply 2 to be pumped through the wellhead and down into the well bore past the heater 30 at the bottom of the well. The fluid flow will change the wellhead 302 and downhole 304 sensor readings. The new sensor readings allow further integrity checks to be performed 518. The heater inlet temperature and outlet temperature, should be identical (if the heater 30 is not energized). The wellhead flow rate measurement 112 Should be consistent with the pressure drop across the heater as measured by downhole sensors 160 and 163. The increased wellhead annulus and tubing pressures should be consistent with the measured downhole pressures after accounting for hydrostatic pressure head and hydraulic resistance. If faults are encountered in either of these tests, an appropriate diagnostic message is displayed and the power controller is automatically shut down so the heater cannot be energized.

If no faults are encountered, the target fluid flowrate is entered as a setpoint 520 and the full flow is initiated 522. The next step requires that power is applied to the heater 30 by the power regulator 208. This step requires a temperature setpoint to be entered by the operator 430 onto the process monitor computer 410 and is shown as 524 on FIG. 6. The temperature setpoint is communicated via LAN 400 to the power controller computer 210 and the appropriate power requirement is calculated. The power requirement (either volts or amps) is then communicated through bus 206 to the power controller 208. The power controller then energizes the heater with the calculated amount of power as shown by 526.

The application of power to the heater will change the signals 528 from the downhole sensors 304. The new sensor readings allow further integrity checks to be performed 530. These diagnostic tests include confirming that the power dissipation in the heater corresponds to the expected temperature rise in the fluid for the particular flowrate. Pressures, temperatures, voltages, amperages and fluid flowrate should all fall within acceptable limits. If not, then the appropriate warning is displayed and the system shuts down. For example, if the injection pressure rises to the maximum allowable, due to poor injectivity into the formation, then the process monitor computer 410 will automatically reduce the injection rate via flow control 116. As the flowrate decreases the heater outlet temperature will increase. The control system will attempt to reduce the heater power: to maintain the heater outlet temperature at its setpoint. However, if the flow has been interrupted catastrophically, so the temperature rise is not controllable, the control system is preferred to achieve a complete power shutdown in less than 200 milliseconds. This rapid shutdown is achieved via downhole sensors 304 data acquisition computer 324 and interlock 220 on the power controller 208.

It will be appreciated by those skilled in the art that the control system algorithm will include a continual updating, or sampling of the sensor data and a comparison to the fault values that constitute a system failure and would require a system shutdown 542. The process of continual updating allows gradual type problems (e.g., plugging of the heater inlet) to be identified and remedial actions to be identified (i.e., backflow) prior to causing equipment failure.

If no faults are encountered at 530 then the data acquisition computer 324 communicates the measured heater outlet temperature to the power control computer 210 across lan 400. The power control computer 210 then compares the temperature set point with the measured temperature 534. If the heater outlet temperature is lower than the temperature set point, a new power set point is calculated by the power control computer 210 and a first control signal 535 will be sent by the power controller computer through the IEEE-488 interface bus 206 and the heater power will be increased causing the fluid temperature at the heater outlet to increase. If the heater outlet temperature is higher than the temperature set point, a different first control signal 535 will be sent by the power unit controller through the IEEE bus and the heater power will be decreased causing the fluid temperature at the heater outlet to decrease.

It will be appreciated by those skilled in the art that in the preferred application as described herein, the first control signal 535 is delivered to the power regulator. This allows a very rapid temperature response to occur downhole. If the measured temperature is within the deadband of the temperature set point, then the next step will be to check the measured flowrate against its setpoint 536.

If the measured flowrate is outside the deadband of the flowrate set point, then the next step will be to send a second control signal 537 to adjust the fluid flowrate via wires 350 to flow control 116. Because there are significant time lags involved with adjusting the flowrate of the fluid, due to fluid volume and compressibility, etc. (5–10 seconds depending on the fluid), fluid flowrate control will be much slower than the temperature control. Thus, fluid flowrate can be freely adjusted via a second control signal as desired and the rapid response time of the temperature control system will still allow the heater outlet temperature to be maintained close to the target setpoint temperature.

It should be noted that a particular flowrate setpoint may not be feasible due to pressure constraints of the equipment. In this case a warning would be issued, and the system may shutdown, dependent on the circumstances.

If the measured flowrate is within the deadband of the flowrate set point, then the next step will be to save the data 538 (power, surface and downhole sensors, setpoints etc) electronically for future analysis. Data is archived in two separate procedures. A fast technique, such as a random access memory (RAM) drive, is used to store all sensor data (sampled every 35 milliseconds) for about 5 minutes in a circular buffer. This data is continuously updated and older data is thrown away. The circular buffer provides a detailed record of events just prior to an emergency shutdown for future diagnosis and post-mortem analysis. The second data archiving procedure involves saving the treatment data at one second intervals. This creates a large, but manageable file with all the (temperature, pressure, flowrate, etc.) data relating to a particular treatment. This data file is useful for post-mortem assessment of treatment performance.

Referring back to FIG. 6, if the treatment is to be continued, then the algorithm loops back from 540 to 522 and repeats. The treatment will normally continue until either sufficient heated fluid is injected into the formation or a fault condition is encountered.

It should be noted that FIG. 6 shows a linear sequence of events in the control algorithm primarily for clarity. In reality, the three microprocessors 410, 324, and 210 and power regulator 208, all work simultaneously on their respective tasks in parallel so the control system response times are achieved in the minimum possible time.

ALARMS

The alarms are chosen in anticipation of the potential failure modes. For example, some potential failure modes include sensor failure, tubing burst, pump failure, electrical short, and heater plugging. A number of parameters are alarmed. These alarms include both measured and calculated parameters and control system status parameters. Alarmed parameters include bottomhole pressure, pressure drop across the heater, tubing pressure, annulus pressure, heater outlet temperature, flowrate, etc. Each alarmed parameter has alarm levels ranging from a notice displayed on the screen of the process monitor computer, through to audible alarms, to a full fledged emergency shutdown of the entire system.

Data collected on the Data Acquisition computer 324 is passed to the process monitor computer 410 every 35 milliseconds. Alarm conditions are checked on the process monitor computer once per second which is adequate for pressure/flow problems. Data collected on the Data Acquisition computer is also passed to the power control computer every 35 milliseconds. Heater outlet temperature is checked every 35 milliseconds on the power controller computer. The power controller computer communicates with the power controller every 150 ms. This allows several data points to be collected and a trend to be clearly established prior to setting a new power level.

System status parameters which are alarmed include network timeout (i.e., if communication between computers is not established within the appropriate time interval). Network timeout problems are assumed to be due to computer malfunction and a power shutdown via the interlock will occur automatically.

The fastest response requirement is for an over-temperature condition at the heater outlet. This situation could arise from a number of causes, principally due to a loss of flow through the heater. As mentioned earlier, a loss of fluid flow could potentially result in a ballistic heating rate for that heater and rapid destruction of equipment, unless the control system is fast to recognize the problem and shutdown the heater power.

Figure 7:
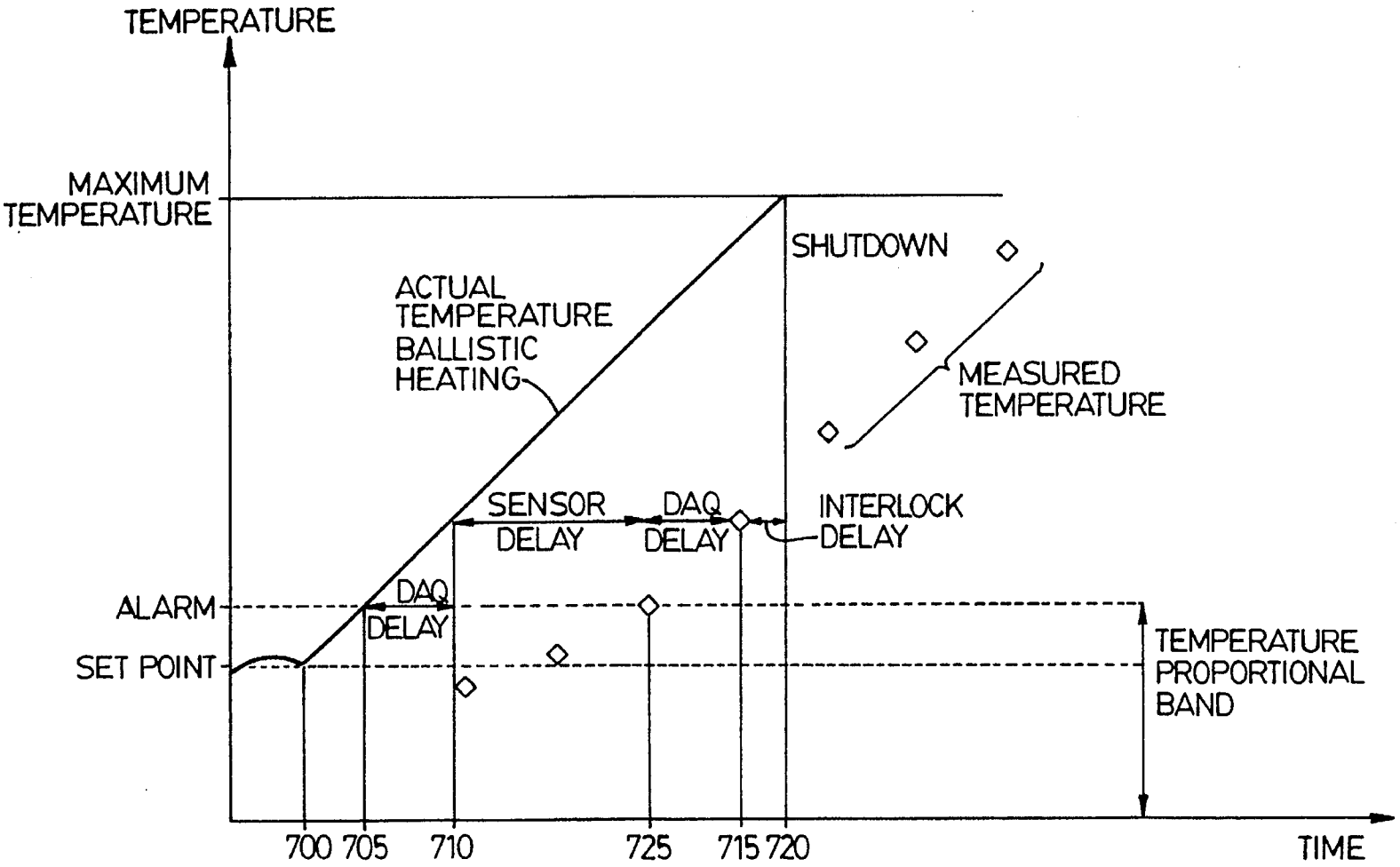
FIG. 7 illustrates the relationship between control system response time and maximum allowable heater temperature under ballistic heating conditions according to the present invention.

FIG. 7 shows response of the control system in the case of a loss of fluid flow and consequent ballistic heating. The bold line represents the true or actual fluid temperature at the heater outlet. The diamond symbols represent the measured temperature as observed at the data acquisition computer (DAQ). The measured temperature lags behind the actual temperature due to delays in the sensor response and in the analog to digital conversion in the data acquisition computer. Furthermore, the measured temperature is only sampled at particular intervals as determined by the cycle time or looping time of the data acquisition computer 210. Thus, the measured temperature (diamonds) is shown as discreet points while the true temperature is shown as a continuous curve.

Initially the heater outlet temperature cycles about the set point temperature. At 700 the fluid flow is interrupted and the heater temperature begins to rise ballistically. At 705, the temperature is sampled; however, it is just below the alarm temperature, so no alarm occurs. At 710 the temperature is sampled again; this time it is above the alarm temperature, so an alarm condition will be detected. However, the alarm condition is not immediately recognized until 715, due to sensor delay (e.g., thermal inertia) and delays in the data acquisition software and hardware (DAQ delay). At 715 the interlock circuit is opened and the power regulator begins shutdown. Power shutdown is achieved at 720.

The control system response relative to the measured temperature is extremely fast. Complete shutdown of the heater power is achieved within 15–20 milliseconds of the detection of an alarm temperature. Use of the interlock allows the network and IEEE-488 bus to be bypassed with a direct shutdown signal to the power controller, thereby eliminating the network delay time. However, due to the delays in the sensor and data acquisition process mentioned above, the actual or true heater temperature will be considerably higher than the measured temperature when shutdown is initiated. For this reason, it is imperative that the control system response is extremely fast.

Additional speed in the detection of an alarm condition is also achieved by feedforward control. In this case, the rate of temperature increase and proximity of the measured temperature to the alarm temperature is used to trigger a shutdown via the interlock. Feedforward control allows an additional 35 ms (i.e., one DAQ delay) to be trimmed from the response time. In this case, an alarm condition would be detected at 705 instead of 710 and the interlock to be opened at 725 instead of 715.

The delay times can be measured as follows; The DAQ delay is the length of time between shorting the heater outlet RTD (to simulate a high temperature) and the time that the interlock circuit opens. The sensor delay is the length of time it takes the sensor to reach 90% of the final reading after a sudden change in fluid temperature (i.e., heater power). Sensor delay would be measured by interrupting the power (via the interlock) and watching the heater outlet temperature decay curve. The interlock delay is measured by the length of time between breaking the interlock circuit and when the heater voltage goes to zero. These three delays determine the overall response time of the control system.

With the system described above the system response time is less than 200 milliseconds. With a ballistic heating rate of 50° C./second the maximum temperature would be less than 10° C. above the alarm temperature. Thus, the alarm temperature can be set within 10° C. of the maximum allowable temperature. Thus, if the maximum allowable temperature is 275° C., the alarm could be set at 265° C. and the heater setpoint could be conveniently set at 230° C., to place the alarm temperature a reasonable amount above the normal fluctuation range around the set point to avoid unnecessary alarm status or subsequent shutdowns of the equipment. Conversely if the control system response was very slow, (i.e. 2 seconds), then the alarm temperature would have to be set 100° C. below the maximum allowable temperature. In this case, the alarm must be set at 175° C. and the setpoint might be limited to a maximum of 140° C. Thus, the fast response of the control system to an alarm condition allows the set point to be closer to the maximum allowable temperature and the output temperature of the heater to be raised. Fast response of the control system allows the heater to operate at a higher temperature so more heat to be carried by the hot fluid, thereby reducing costs and improving effectiveness of the treatment.

CONTROL SYSTEM HARDWARE

In one form of this invention, the controller includes an Intel 80486 ("486") stand alone microprocessor 410 at a process monitor connected by a LAN 400 to a 486 data acquisition 324 and a 486 power control computer 210. The data acquisition computer 324 is electrically isolated from the process monitor computer and the power controller computer by fibre-optic links. Thus, the data acquisition computer can be exposed to high voltage through an electrical short on the downhole sensors without risk to the operators.

Injection rate control is achieved by sensing the flowrate at the wellhead 112, passing the signal via conductors 22 to the data acquisition computer 324, passing the digital data via LAN 400 to the process monitor computer 410, comparing the setpoint to actual flowrate and sending a control signal via 350 to flow control 116. Flow control 116 could be achieved by either indirect analogue control of a bleed valve or the pump throttle control. It will be appreciated by those skilled in the art that the three 486 microprocessors are convenient for this application although other hardware configurations would also be appropriate. Essentially what is required is sufficient data recording and data manipulation capacity to provide the real time operating control of the heater and the fluid injection system that comprise the apparatus. Other hardware configurations are also appropriate as will be appreciated by those skilled in the art.

It will be appreciated by those skilled in the art that many variations are possible within the broad scope of the invention as defined by the appended claims. Some of these have been noted above and others will be apparent. For example, although the foregoing description describes three stand alone microprocessors, the functions could be combined into a single unit of sufficient size and speed. Furthermore, it is anticipated that the speed of the microprocessors will increase as the microprocessor technology matures, so further improvements in response time will be possible. Also, while the stimulation described is a hot solvent squeeze, the control system will be applicable to other types of well treatments that require the controlled application of heat downhole.

We claim:

1. A method of stimulating hydrocarbon recovery from a well, comprising the steps of:

a) providing a well stimulation apparatus including a downhole heater in the well, a source of electrical power, conductors connecting said downhole heater to said source of electrical power, and a fluid injection system including a source of fluid and a pump for pumping the fluid, b) connecting a control system to the well stimulation equipment, the control system including one or more of temperature, pressure and flow sensors to sense the flow of fluid past said heater and into a formation surrounding said well, a central computational unit and means for communicating readings from said sensors to said central computational unit, said central computational unit including means for receiving and manipulating said sensor readings and generating a control signal for said source of electrical power to vary the power to achieve a set point temperature at said heater;

c) establishing a maximum temperature which if exceeded is likely to cause damage to the well or the stimulation equipment;

d) determining a response time which is a length of time between the beginning of a no flow condition at the heater and the receipt, by the source of electrical power, of a control signal from the control system substantially shutting down the source of electrical power;

e) calculating the temperature rise which occurs at the heater during said response time, f) subtracting the temperature rise calculated from step e) from the maximum temperature established in step c) to obtain a desired operating temperature; and g) setting the set point temperature of said control system at or below said desired operating temperature and f) injecting fluid past said heater into said formation, wherein said control system maintains said fluid temperature exiting said heater at about said set point.

2. The method of claim 1 further including the steps of:

establishing a maximum safe operating pressure for said fluid in said well;

determining an actual pressure in said well by monitoring said pressure sensor;

comparing the measured fluid pressure to the maximum safe operating pressure, and if the measured pressure is higher, reducing the fluid flow rate to said heater to reduce said pressure and if the measured fluid pressure is lower, increasing the fluid flow rate.

3. The method of claim 2 wherein said safe operating pressure and said set point temperature are set at an upper safe operating range to minimize the time for a given stimulation.

4. The method of claim I wherein said step e) is calculated assuming that a maximum of power available from said power source is being delivered to said heater.

5. The method of claim I wherein said power source is limited to provide only such amount of power as is used in the calculation of the temperature rise in said response time.

6. The method of claim I wherein said control system further includes a monitor for displaying said measured pressures and fluid temperatures.

7. The method of claim 1 further including the step of providing an alarm in the event that the measured pressure or temperature exceeds a predetermined alarm level, which is higher than said maximum safe operating pressure or said set point temperature.

8. The method of claim 7 wherein said step of providing an alarm comprises providing a visual alarm on said monitor.

9. The method of claim 7 wherein said step of providing an alarm comprises providing an audible alarm.

10. A control system for well stimulation equipment, the well stimulation equipment including a downhole heater in the well, a source of electrical power, conductors connecting said downhole heater to said source of electrical power, and a fluid injection system including a source of fluid and a pump for pumping the fluid, the control system comprising:

one or more of temperature, pressure and flow sensors to sense the flow of fluid past said heater and into a formation surrounding said well, a central computational unit and means for communicating readings from said sensors to said central computational unit and from said central computational unit to said source of electrical power, said central computational unit including means for receiving and manipulating said sensor readings and generating a control signal for said source of electrical power to vary the power to achieve a set point temperature at said heater, said control system having a response time defined as the time between a no flow condition occurring and a control signal from said control system substantially shutting off said source of electrical power;

wherein said set point temperature is set at about a maximum permissable temperature less the temperature rise over time for a no flow condition in said heater times said response time.

11. The control system of claim 10 wherein said response time is under two seconds.

12. The control system of claim 10 wherein said response time is under one second.

13. The control system of claim 10 wherein said maximum permissable temperature is in the range of between 250 and 300 degrees celsius.

14. The control system of claim 10 wherein said set point temperature is at set between 175 degrees and 215 degrees celsius.

15. The control system of claim 10 wherein said central computational unit compares a measured pressure to a predetermined safe maximum operating pressure and if the measured pressure is higher, generates a control signal to said fluid injection system to reduce the fluid flow rate to said heater to reduce said pressure and if the measured fluid pressure is lower, generates a control signal to said fluid injection system to increase the fluid flow rate.

16. The control system of claim 15 further including sensors to monitor the fluid flow in said fluid injection system at or near the surface.

17. The control system of claim 10 further including a temperature sensor located upstream of said heater, and if a temperature rise is detected at said upstream temperature sensor, an alarm signal is created.

18. A well treating system for stimulating hydrocarbon recovery from an underground formation, the formation being connected to a well extending from the formation to the surface and having a well head located at or near the surface, the well treating system comprising:

a downhole electrical resistance heater which may be inserted into the well and located adjacent to the hydrocarbon bearing underground formation, the downhole heater having a rate of increase of temperature in a no flow condition at full power defined as a ballistic heat rate;

a source of electrical power located at or near the well head;

a microprocessor controlled power regulator;

electrical conductors connected between the source of electrical power and the downhole heater for conducting electrical power to the downhole heater;

a source of fluid located at or near the well head;

at least one pump located at or near the well head for pumping a fluid from said fluid source past said downhole heater and into the formation;

at least one first sensor, associated with the downhole heater, for providing at least one first output signal corresponding to an outlet temperature of said fluid flowing past said heater;

at least one second sensor, associated with said well, for providing a second output signal corresponding to the flow rate of fluid flowing past the downhole heater and into the formation; and a control system comprising one or more of temperature, pressure and flow sensors to sense the flow of fluid past said heater and into a formation surrounding said well, a central computational unit and means for communicating readings from said sensors to said central computational unit and from said central computational unit to said source of electrical power, said control system receiving and manipulating said sensor readings and generating a control signal for said source of electrical power to vary the power to generally maintain a set point temperature at said heater, said control system having a response time defined as the time between a no flow condition occurring at said heater and a control signal from said control system substantially shutting off said source of electrical power;

wherein said set point temperature is set at or less than a maximum permissable temperature for said well less the product of the ballistic heating rate for said heater times said response time.

* * * * *